US006454564B2

(12) United States Patent
Ricchio et al.

(10) Patent No.: US 6,454,564 B2
(45) Date of Patent: Sep. 24, 2002

(54) WORKPIECE SUPPORT TRAYS FOR FURNANCES

(75) Inventors: Lawrence Ricchio, Grand Rapids; Ahmed Abada, Wyoming; Christopher Roys, Grand Rapids, all of MI (US)

(73) Assignee: Steeltech Ltd., Grand Rapids, MI (US)

( * ) Notice: Subject to any disclaimer, the term of this patent is extended or adjusted under 35 U.S.C. 154(b) by 0 days.

(21) Appl. No.: 09/881,520

(22) Filed: Jun. 14, 2001

Related U.S. Application Data

(60) Provisional application No. 60/212,310, filed on Jun. 16, 2000.

(51) Int. Cl.[7] ..... C21D 9/00
(52) U.S. Cl. ..... 432/261
(58) Field of Search ..... 432/261, 241, 432/126, 127; 206/557, 560, 565; 266/274

(56) References Cited

U.S. PATENT DOCUMENTS 2,145,708 A * 1/1939 Balney ..... 432/261
2,417,083 A * 3/1947 Menough ..... 432/261
2,765,159 A 10/1956 Garofalo
3,025,045 A 3/1962 Ornitz
3,044,755 A 7/1962 Bixby
3,156,456 A 11/1964 Menough
4,308,009 A 12/1981 Surachai

* cited by examiner

*Primary Examiner*—Jiping Lu
(74) *Attorney, Agent, or Firm*—Price, Heneveld, Cooper, DeWitt & Litton

(57) ABSTRACT

A flexible, relatively lightweight workpiece support tray includes a plurality of spacers juxtaposed between a plurality of lateral I-beams, the I-beams being held together through a plurality of rods. Each of the lateral I-beams has a recess for receiving a tab on each side of the spacers. Each end of the rods is provided with a split ring welded thereon to removably retain the assembly together. A pair of shoes is located on the bottom intended side of the tray, and a puller/pusher bar is attached to each end of the shoe for engaging the drive mechanism of the furnace. The invention uses articulating attachments, including includes a slide connector and T-connector spot welded into place, for joining one tray to another to obtain a floating feature.

20 Claims, 12 Drawing Sheets

WORKPIECE SUPPORT TRAYS FOR FURNANCES

CROSS-REFERENCE TO RELATED APPLICATION

This application claims priority under 35 U.S.C. § 119(e) on U.S. Provisional Application No. 60/212,310, entitled WORK PIECE SUPPORT TRAYS FOR FURNACES, filed on Jun. 16, 2000, by Gary Salerno, Lawrence Ricchio, Ahmed Abada, and Chris Roys, the entire disclosure of which is incorporated herein by reference.

BACKGROUND OF THE INVENTION

1. Field of the Invention

This invention relates to a workpiece support tray for use in furnaces. More particularly, the present invention relates to a workpiece support tray assembly having a replaceable push/pull bar removably coupled to removable guide shoes and an articulating connector for facilitating smooth motion through modem furnaces while avoiding warping and jamming during use.

2. Description of the Related Art

Workpiece support trays are commonly used for the batch heat treatment of metal articles in high temperature furnaces. Such metal articles include gears, bearings, connecting rods, and other articles that are subject to frequent high loads, where heat treatment of the outside surface is desired to prevent wear, but where the interior of the teeth or other load bearing component retains its flexible and ductility for improved fatigue resistance.

Furnaces commonly use support trays, loaded with the workpiece to be hardened, that are simply lowered onto and lifted off furnace piers or supports with forklifts. Other furnaces have been developed having roller rail and chain-driven systems for feeding the workpiece support tray into the heating chamber of the furnace. Such furnaces, so-called "IQ," or integral quench furnaces, use such roller rail systems to guide the workpiece support tray into the heating chamber vestibule having a plenum and a heat box. The heating chamber vestibule is further integrally combined to another section of the furnace, the quench tank.

As is known, the quench bath can be of either oil or water, depending on the speed and extent of quenching desired. After quenching, the workpiece support tray and workpiece articles are lifted out of the quench bath and then typically removed from the furnace by the roller rail and chain drive systems into a wash tank that also contains the same roller rail system. The workpiece support tray and the workpiece articles are there washed. After the wash tank, the workpiece support tray is typically transported to a draw furnace, where the draw furnace heats the workpiece support tray and the workpiece articles to obtain the desired case depth or hardness, based on the specification to which the workpiece articles are to be treated.

The furnaces that typically use the roller rail system for moving the workpiece support tray and the workpiece articles placed thereon often heat the workpieces to between 1700 and 1900° F., followed by a quenching to 150 to 200° F. in a matter of two minutes or less. Thus, the workpiece support tray must be capable of cycling many times through this extreme thermal cycle, and the expansion and contractions resulting therefrom. In sum, the workpiece support tray must be a very robust and durable product.

However, prior art workpiece support trays were typically formed from a solid cast tray or grid, some of which included integrally cast shoes, or a pair of rails, that rest upon the rollers and roller rails of the furnace. But, when subjected to the heating and quenching cycles, all metals will reach a useful thermal cycle life, including the alloys used for workpiece support trays. Not only are solid cast trays damaged by impacts from forklifts and other handling, after a number of heating and cooling cycles, a precipitation of carbides occurs, changing the grain boundaries in the metal. As this occurs, the metal simply does not hold together as strongly and as resiliently and becomes quite brittle and subject to fracture. At some point, the alloy's useful life is simply over. However, the entire trays of the solid cast type typically never reach that point, due to breakage of only a portion. If a corner is broken, the entire tray usually must be scrapped or repaired. While the corner can be welded back in place, such welds typically do not work very well. Moreover, as the alloy becomes carburized, carbon diffuses the metal and must be ground out before it can be welded. Even in the best cases, the weld will only be 80 or 90% as strong as the original cast using traditional welding processes. Thus, once a section is broken off, unless it can be reliably re-welded on, the solid cast tray may be unusable.

Also, if a corner of the tray breaks off and cannot be replaced and the loading of articles on the tray remains the same, the local stress, determined in pounds per square inch, will also increase, depending on how much of the tray is missing. As the tray is heated, this will cause the tray to sag. When attempts are made to remove the tray from the furnace, it may not track on the roller rail system properly and it may catch or snag on objects, This can be very detrimental to the furnace.

If the chain guide and roller rail systems of the furnace become obstructed, and the tray will not pull out or it becomes snagged, or if a temporary snag causes any of the workpiece articles to fall from the tray into the furnace, the furnace must be shut down. It must be allowed to cool down, after which a person must enter the furnace and remove all the parts and repair the damage. The furnace may be down for days, as it takes several days just to cool. Some furnaces also have radiant tubes on the sidewalls and/or use electric heating elements, which can be broken, cracked or shorted out by a jammed tray or fallen workpiece article. Moreover, persons that enter such furnaces must be certified and experienced in order to do the work. Thus, a reliable support tray is highly desirable.

Moreover, the stiffness of solid cast trays of the prior art created difficulties in the case of worn furnace rollers. The rollers typically have a flange on each side. They sit relatively close to each other within mountings and are typically not bolted in. With time and use, they become distorted and not necessarily flat. In some cases, the difference in height between rollers could be a quarter of an inch over a 10 inch span. As the tray heats, it thus warps and sags. As the rails of the sagging portions of the cart trays are pulled over the roller rails, they hit the face of the roller, causing the tray to lift up. As the tray rises and lifts up, the load can shift and the tray can be pushed off the track.

Also, cast trays are occasionally connected one to the other with fasteners to improve the throughput of the furnace. However, if bolted and not put together properly, the nuts and bolts can come loose. Worse yet, one tray can rise or fall relative its neighboring tray(s), causing too high of a gap and also allowing the tray to fall down off the roller.

Further, solid cast trays are formed with an inherent draft in order to facilitate their removal from the core pattern within which the trays are molded. When such cast trays are bolted together, the cast trays are thinner at the top than the bottom because of this draft. But if bolted together tightly to avoid jamming on the rollers, the angle of the draft is sometimes imposed into the assembly, especially after heating, forming the tray assembly into a "V." In turn, this formation can lift the trays up off of the rollers, also causing a jam in the furnace.

While there are non-solid cast tray systems, none have been able to fully overcome the shortcomings of the prior art solid cast trays. For example, U.S. Pat. Nos. 2,765,159, 3,025,045, 3,044,755, 3,156,456, and 4,308,009 all teach non-solid heat treating grids or trays. However, none are considered appropriate for IQ furnaces, as is the tray of the present invention, and none are apparently capable of being reliably drawn through a furnace on roller rail and chain-driven systems now currently in use.

SUMMARY OF THE INVENTION

The solution to these shortcomings of the prior art, and other features, advantages and objects of the present invention will be further understood and appreciated by those skilled in the art by reference to the following specification, claims and appended drawings. According to the present invention, an articulating, flexible, relatively lightweight workpiece support tray includes a plurality of spacers juxtaposed between a plurality of lateral I-beams, the I-beams being held together through a plurality of rods. Each of the lateral I-beams has a recess for receiving a tab on each side of the spacers, such that when assembled, the spacers are loosely restrained within the I-beams. Each end of the rods is provided with a split ring washer welded thereon to removably retain the assembly together. The assembly can be reversed at any time to correct warpage or sag; that is, it can simply be turned over to correct any deformations or the offending component can be replaced.

A pair of shoes designed to engage the roller rail system of the furnace are removably attached to spacers, such that the shoes are located on the bottom intended side of the tray. Threaded fasteners or, preferably, pins and cotter keys, can be used to attach the shoes. Preferably, a puller/pusher bar is attached to each end of the shoe for engaging the drive mechanism of the furnace. The use of the one-piece shoe with the pusher/puller bar allows the portions of the tray most commonly subject to the most damage, that is, the rails and the puller/pusher bar, to be easily attached or detached.

A further aspect of the invention is use of articulating attachments for joining one tray to another to obtain a floating feature. The articulating attachment includes a slide connector and T-connector spot welded into place when assembled. The slide connector engages oversized openings in cooperating end I-beams of the adjacent trays and is engaged by the T-connector. The spot welds can be easily ground away to disassemble the trays.

Combined with the oversized openings for all interfitting components, a loose design is obtained having significant advantages over the solid cast trays of the prior art, and allows the tray to expand and contract, while remaining flexible, for a much more durable product. Moreover, the support tray of the present invention provides a reliable platform upon which articles to be heat-treated can be processed.

The above brief description sets forth rather broadly the more important features of the present disclosure so that the detailed description that follows may be better understood and so that the present contributions to the art may be better appreciated.

As such, those skilled in the art will appreciate the conception, upon which this disclosure is based, may readily be used as a basis for designing other structures, methods and systems for carrying out the purposes of the present invention. It is important therefore that the claims are regarded as including such equivalent instructions as far as they do not depart from the spirit and scope of the present invention.

In this respect, before explaining the preferred embodiment of the disclosure in detail, there are, of course, additional features of the disclosure that will be described hereinafter which would form the subject matter of the claims appended hereto, to be understood that the disclosure is not limited in its application to the details of the following description or drawings. The workpiece support trays of the present disclosure is capable of other embodiments and of being practiced and carried out in various ways. Also, it is to be understood that the phraseology and terminology employed herein are for description and not limitation. Where specific dimensional material specifications have been included or omitted from the specification of the claims, or both, it is to be understood that the same are not to be incorporated into the appended claims.

As such, those skilled in the art will appreciate the conception, upon which this disclosure is based, may readily be used as a basis for designing other structures, methods and systems for carrying out the purposes of the present invention. It is important therefore that any claims are regarded as including such equivalent instructions as far as they do not depart from the spirit and scope of the present invention.

Further, the purpose of the Abstract is to enable the U.S. Patent and Trademark Office and the public generally, especially the scientists, engineers and practitioners in the art who are not familiar with the patent or legal phraseology, to learn quickly from a cursory inspection the nature and essence of the technical disclosure of the application. Accordingly, the Abstract is intended to define neither the invention nor the application, which is only measured by claims, nor is it intended to be limiting as to the scope of the invention in any way.

These and other features, advantages and objects of the present invention will be further understood and appreciated by those skilled in the art by reference to the following specification and appended drawings.

BRIEF DESCRIPTION OF THE DRAWINGS

The disclosure of the workpiece support tray of the present invention is explained with illustrative embodiments shown in the accompanying drawings, where.

DETAILED DESCRIPTION OF PREFERRED EMBODIMENT

Figures 1, 2:
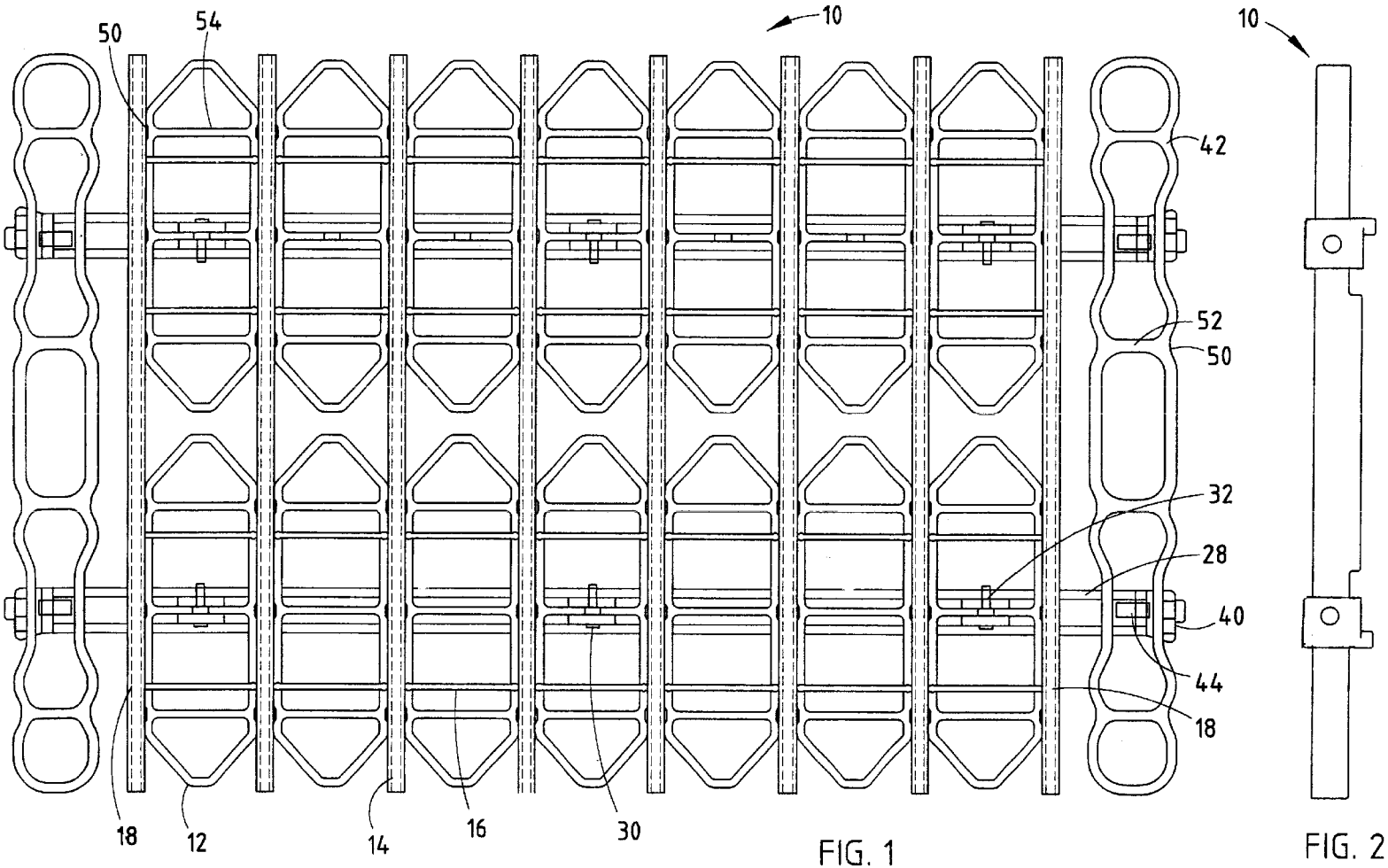
FIG. 1 is a top plan view of a first embodiment of a workpiece support tray embodying the present invention.
FIG. 2 is an end view of a first embodiment of a workpiece support tray embodying the present invention.
Figure 3:
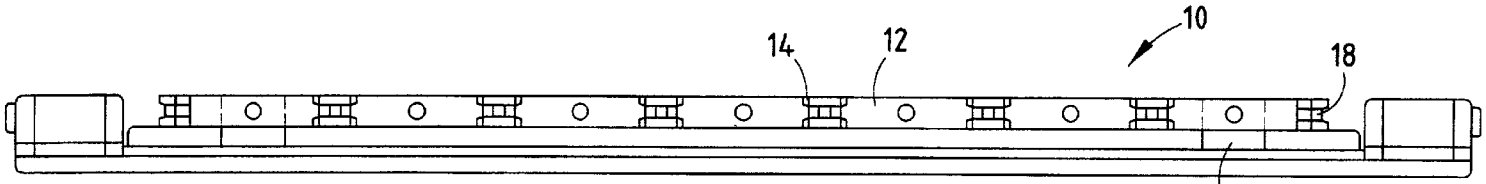
FIG. 3 is a side end view of a first embodiment of a workpiece support tray embodying the present invention.
Figure 4:
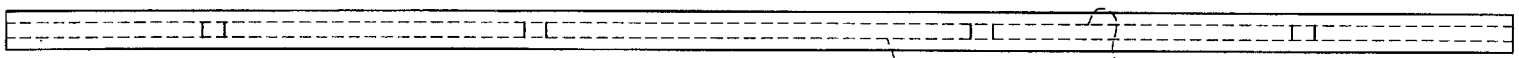
FIG. 4 is a top plan view of the I-beam of a first embodiment of a workpiece support tray embodying the present invention.
Figure 5:
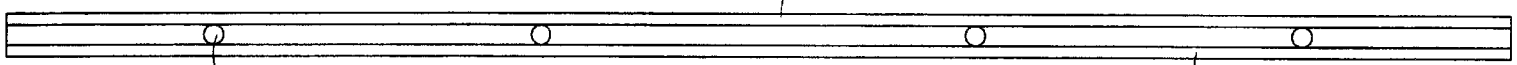
FIG. 5 is a side view of the I-beam of a first embodiment of a workpiece, support tray embodying the present invention.
Figure 7:
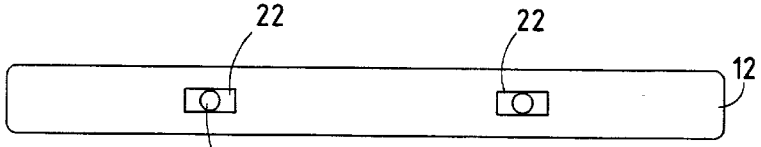
FIG. 7 is a side view of the spacer of a first embodiment of a workpiece support tray embodying the present invention.
Figure 6:
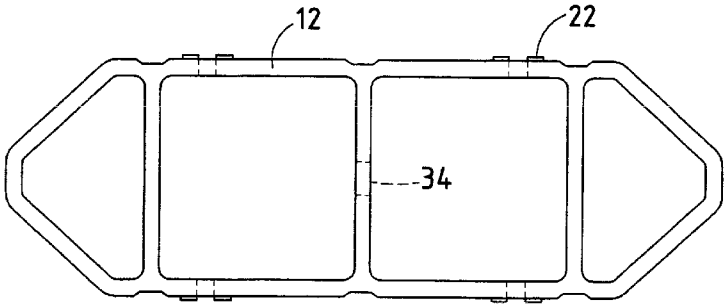
FIG. 6 is a top plan view of the spacer of a first embodiment of a workpiece support tray embodying the present invention.

The best mode for carrying out the invention is presented in terms of the preferred embodiment, wherein similar reference characters designate corresponding features throughout the figures of the drawings. Referring now to the drawings, particularly FIG. 1, there are shown the basic components of the workpiece support tray 10 of the present invention. A plurality of identical spacers 12, preferably in rows of two abreast, are juxtaposed between a plurality of identical lateral I-beams 14, as shown. The I-beams 14 are held together through a plurality of rods 16. Each of the lateral I-beams 14 has a recess 20, preferably extending longitudinally thereon, for receiving a tab 22 on each side of the spacers 12, such that when assembled, the spacers 12 are loosely restrained within the I-beams 14. The spacers 12 and I-beams 14 each have openings 24 and 26, respectively, to receive the rods 16, the inner diameter of the opening 24 and 26 being sufficiently larger than the outer diameter of the rods 16 so that a relatively loose fit is obtained.

Each end of the rods 16 are provided with a split ring washer 18 welded thereon to removably retain the assembly 10 together. It has been found that a threaded fastener at the end of the rods 16 usually has to be cut off anyway. The rods 16, as are the other wrought metals of the tray 10, preferably manufactured from 330 stainless steel. The rods 16 are preferably 5/16 inch in diameter. When the split ring washer 18 is welded in place, a gap is maintained between the split ring 18 and the end I-beam 14 as the rods 16 grow. The split ring washer 18 is thus preferably not welded to the I-beam 14, allowing minor relative movement. When the tray 10 is to be disassembled, the split ring washer 18 is simply cut off and replaced with a new split ring washer 18. The split ring washer 18 operates basically like a shoulder against the I-beam 14.

The number of spacers 12 and the number of I-beams 14 used is based on the load put through the furnace, which typically varies from 2500 to 4,500 lbs. Typical preferred standard sizes are 30×48 inches and 36×48 inches. Largely, the size depends on the customer's requirements and the capacity of the furnace. Of course, other sizes can be obtained by changing the spacer 12 size or adding additional rows in the array of spacers 12 and I-beams 14. In contrast, with the solid cast trays of the prior art, the only alternative was to accept average sizes and require the user to stack the trays in the furnace. Thus, the design of the present invention, by adjusting the number and size of spacers 12 and I-beams 14 and the size, thickness, and cross-sections thereof, allows ready variation of the load that can be put in the furnace.

Figure 28:
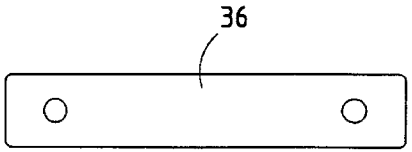
FIG. 28 is a plain view of the connecting pin of a second embodiment of a workpiece support tray embodying the present invention.
Figure 30:
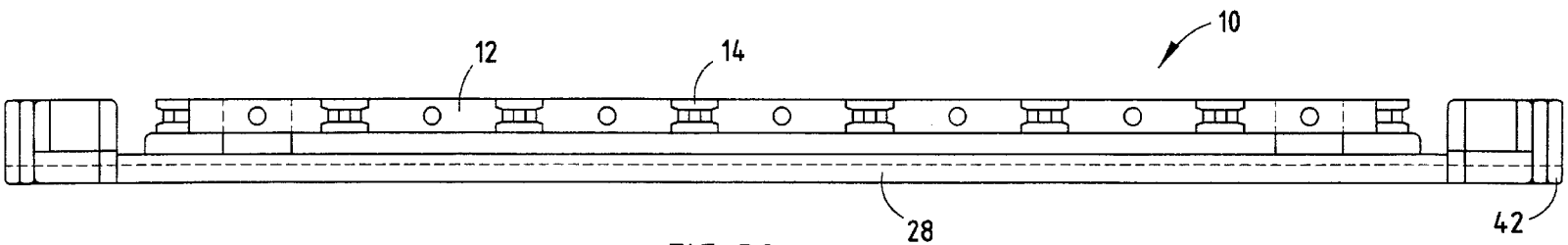
FIG. 30 is a side view of a third embodiment of a workpiece, support tray embodying the present invention.
Figure 31:
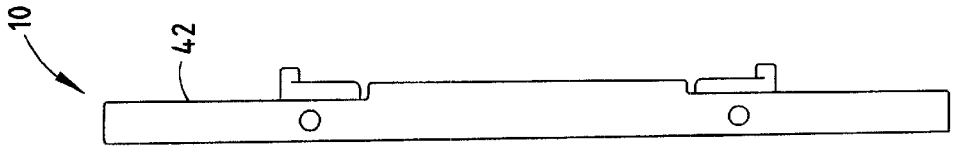
FIG. 31 is an end view of a third embodiment of a workpiece support tray embodying the present invention.
Figure 29:
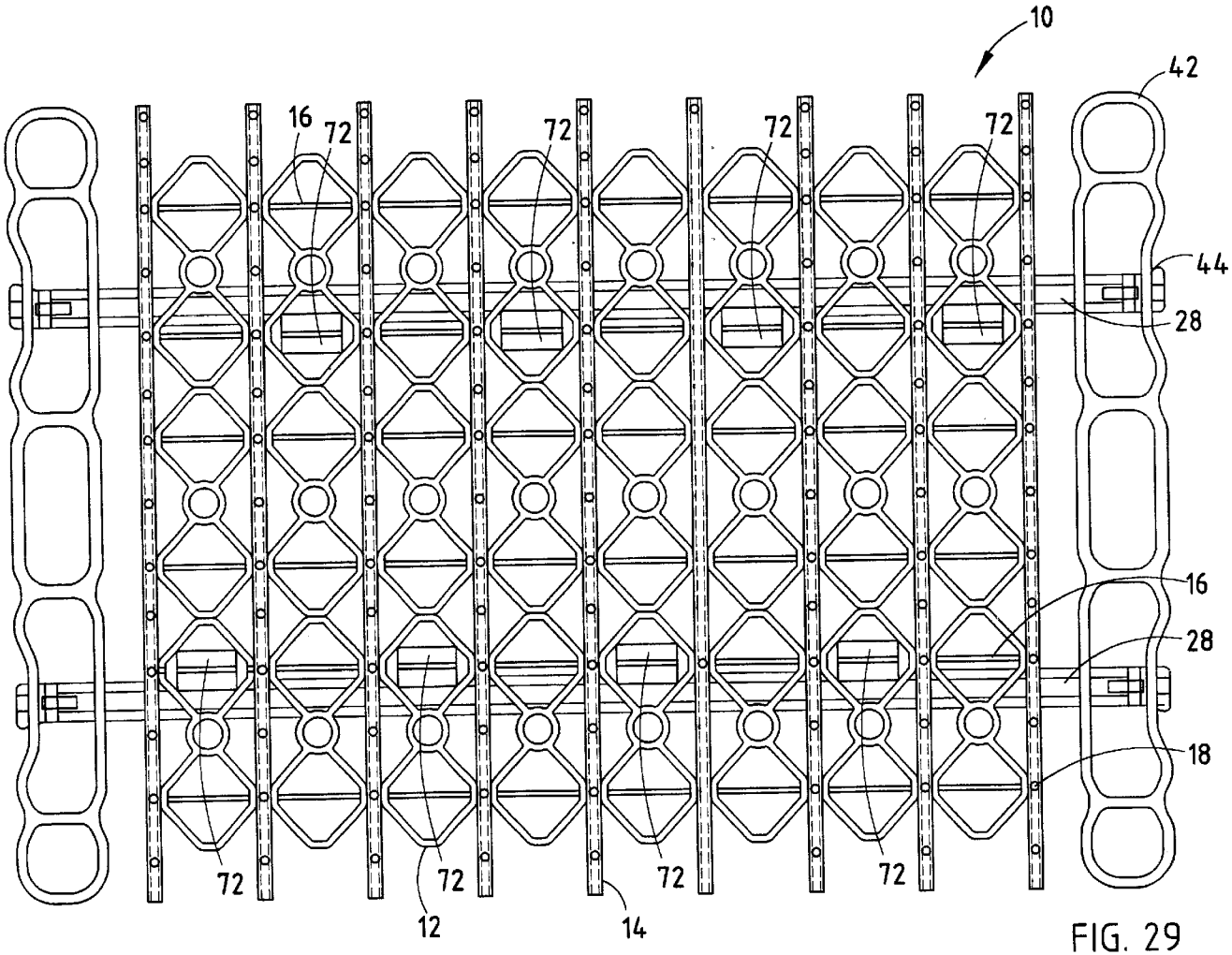
FIG. 29 is a top plan view of a third embodiment of a workpiece support tray embodying the present invention.
Figure 32:
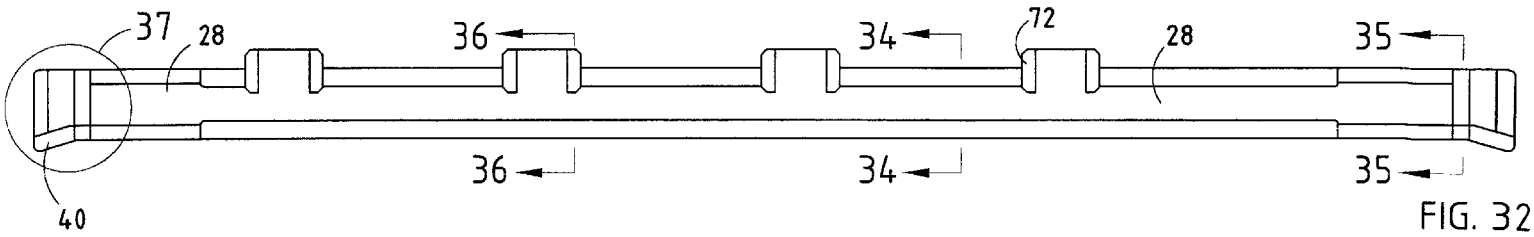
FIG. 32 is a top view of the shoe of a third embodiment of a workpiece support tray embodying the present invention.
Figure 33:
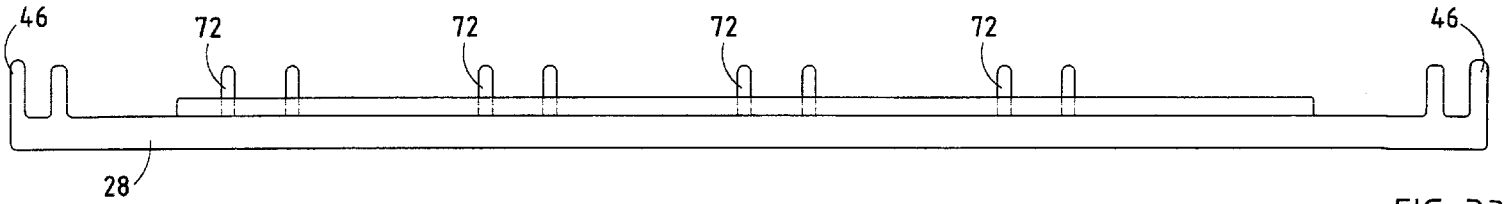
FIG. 33 is a side view of the shoe of a third embodiment of a workpiece, support tray embodying the present invention.
Figure 37:
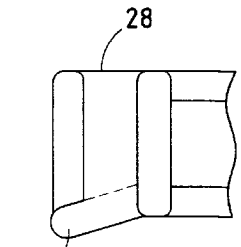
FIG. 37 is an enlarged view of the end of the shoe of a third embodiment of a workpiece support tray embodying the present invention.
Figure 36:
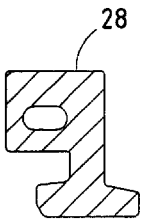
FIG. 36 is a sectional view of the shoe of a third embodiment of a workpiece support tray embodying the present invention taken along the line 36—36 in FIG. 23.
Figure 35:
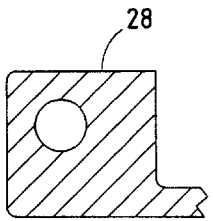
FIG. 35 is a sectional view of the shoe of a third embodiment of a workpiece support tray embodying the present invention taken along the line 35—35 in FIG. 23.
Figure 34:
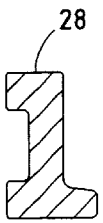
FIG. 34 is a sectional view of the shoe of a third embodiment of a workpiece support tray embodying the present invention taken along the line 34—34 in FIG. 23.
Figure 42:
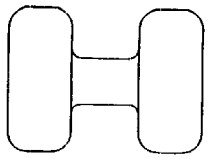
FIG. 42 is an end view of the I-beam of a third embodiment of a workpiece support tray embodying the present invention.
Figure 38:
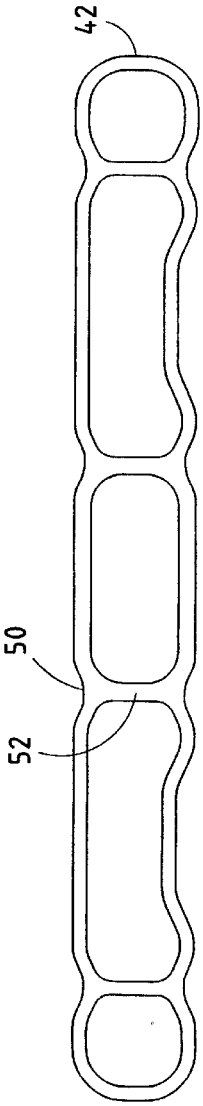
FIG. 38 is a top view of the pusher/puller bar of a third embodiment of a workpiece support tray embodying the present invention.
Figure 39:
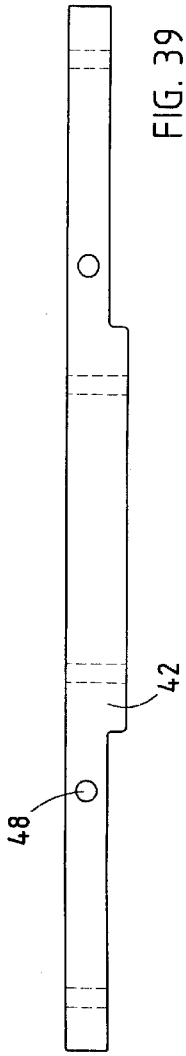
FIG. 39 is a side view of the pusher/puller of a third embodiment of a workpiece, support tray embodying the present invention.
Figure 40:
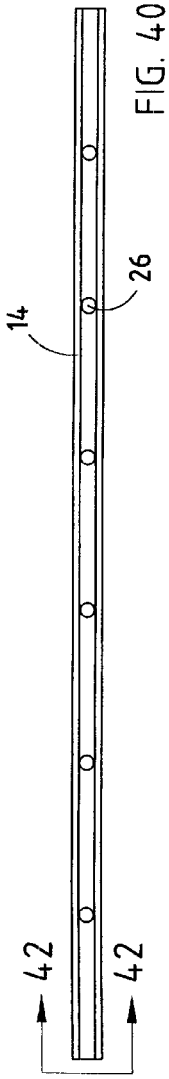
FIG. 40 is a top view of the I-beam of a third embodiment of a workpiece support tray embodying the present invention.
Figure 41:
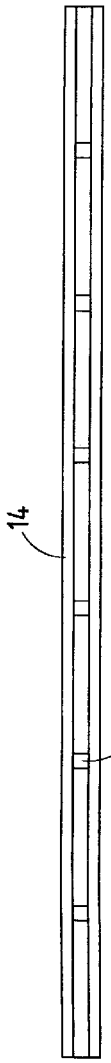
FIG. 41 is a side view of the I-beam of a third embodiment of a workpiece support tray embodying the present invention.
Figure 45:
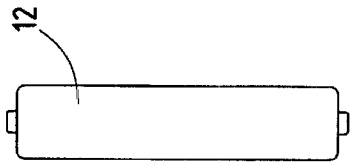
FIG. 45 is an end view of the spacer of a third embodiment of a workpiece support tray embodying the present invention.
Figure 43:
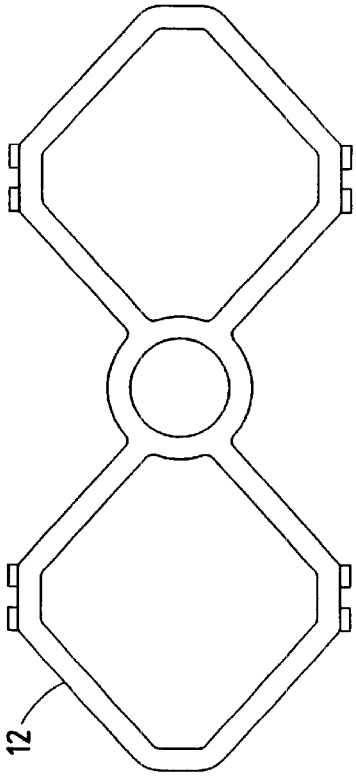
FIG. 43 is a top view of the spacer of a third embodiment of a workpiece support tray embodying the present invention.
Figure 44:
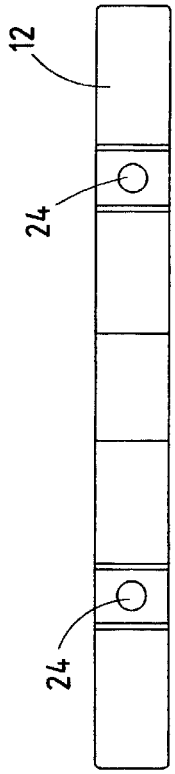
FIG. 44 is a side view of the spacer of a third embodiment of a workpiece support tray embodying the present invention.

As shown in the Figures, a pair of detachable shoes 28 is provided to engage the roller rail system of the furnace. The shoes 28 are preferably removably attached to the spacers 12 through fasteners 30 projecting through ears 32 of the shoes, the fastener 30 being positioned above and through openings 34 of the spacers 12, such that the shoes are located on the bottom intended side of the tray 10. Of course, the shoes 28 can be placed on the opposite side as desired to correct warpage or sag. Again, the inner diameter of the opening 34 is sufficiently larger than the outer diameter of the fastener 30 so that a relatively loose fit is obtained. Alternatively, as shown in the alternative embodiment of FIG. 17, the threaded fasteners 30 are preferably replaced with machined pins 36 and cotter keys 38 to attach the shoes, the same being reusable. The pins 36, shown in FIG. 28, are essentially 330 stainless steel pins that are drilled to accept the cotter keys 38. Stainless steel wire (not shown), pulled through the pin 36 and then twisted around it will also work, as there is no stress on this particular component. The primary goal is keeping the pin 36 from sliding out.

Figure 11:
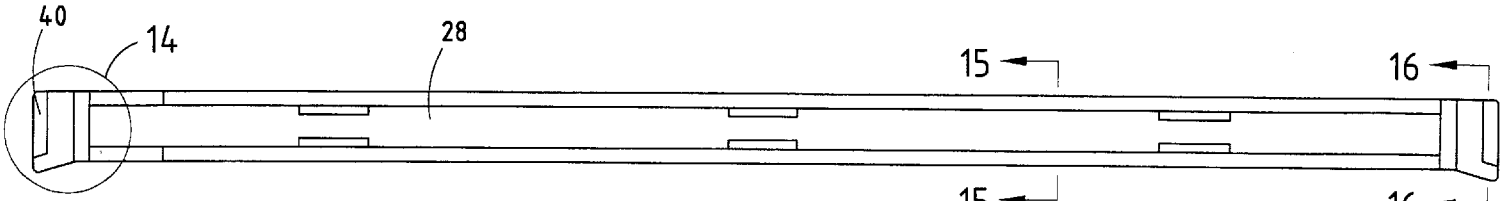
FIG. 11 is a top plan view of the shoe of a first embodiment of a workpiece support tray embodying the present invention.
Figure 13:
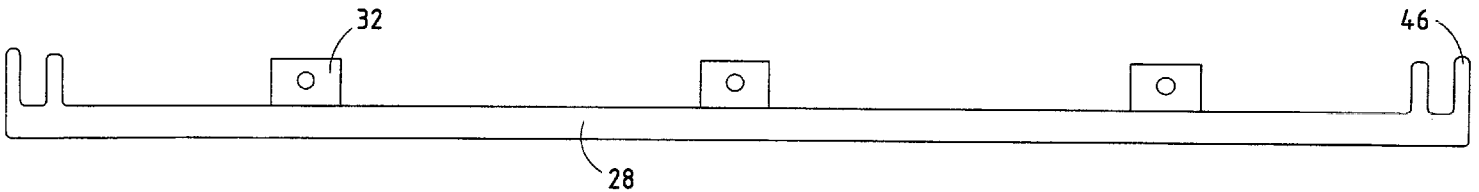
FIG. 13 is a side view of the shoe of a first embodiment of a workpiece support tray embodying the present invention.
Figure 16:
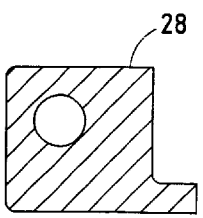
FIG. 16 is a sectional view of the shoe of a first embodiment of a workpiece support tray embodying the present invention taken along the line 16—16 of FIG. 11.
Figure 15:
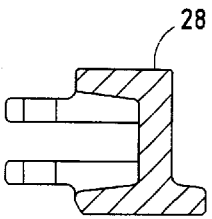
FIG. 15 is a sectional view of the shoe of a first embodiment of a workpiece support tray embodying the present invention taken along the line 15—15 of FIG. 11.
Figure 14:
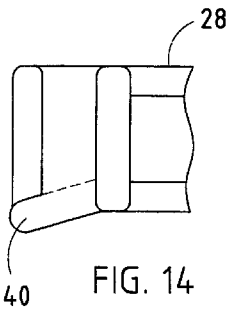
FIG. 14 is a detail view of one end of the shoe of a first embodiment of a workpiece support tray embodying the present invention.
Figure 12:
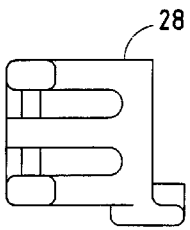
FIG. 12 is an end view of the shoe of a first embodiment of a workpiece support tray embodying the present invention.
Figure 18:
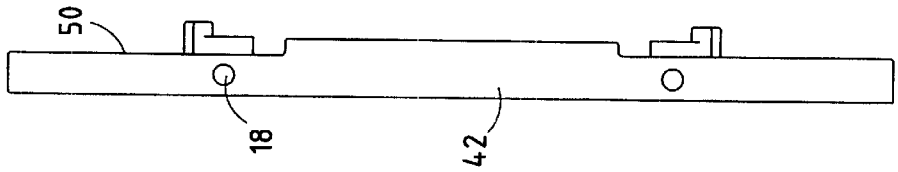
FIG. 18 is an end view of a second embodiment of a workpiece, support tray embodying the present invention.

Preferably, as best shown in FIGS. 11 and 14, the one-piece shoes 28 include a lip 40 at each end to engage the flange of the furnace roller wheel and gently urge the tray 10 into alignment with the direction of travel of the furnace roller rail system. The shoes 28 can be mounted wider or narrower, depending on the track of the furnace roller rail system. For example, the rollers on the 36 inches wide size trays preferably have rails set at 21 inches apart and the 30 inches wide size tray is 15 inches apart, that is, 10.5 inch and 7.5 inches from centerline, respectively. For furnaces requiring a 36-inch wide size tray, for example, one type of furnace will preferably require the shoe 28 to be slightly wider than 21 inches apart because of the wider rollers typically used therein. Also, for a tray 36 inches wide, the shoes 28 are preferably longer. However, the center to center distance of the roller rail systems can vary between furnaces of the same size.

A puller/pusher bar 42 is attached, preferably by threaded fasteners or pins and keys 44, to each end of the shoes 28 through bracket 46 located at each end of the shoes 28. The puller/pusher bar 42 has openings 48 to receive the fasteners 44, the inner diameter of the openings 48 likewise being sufficiently larger than the outer diameter of the fasteners 44 so that a relatively loose fit is obtained. The puller/pusher bar 42 engages the drive mechanism of the furnace. Thus, the use of the one piece shoe 28 and puller/pusher bar 42 allows those portions of the tray 10 subject to the most damage to be easily attached or detached.

Figure 9:
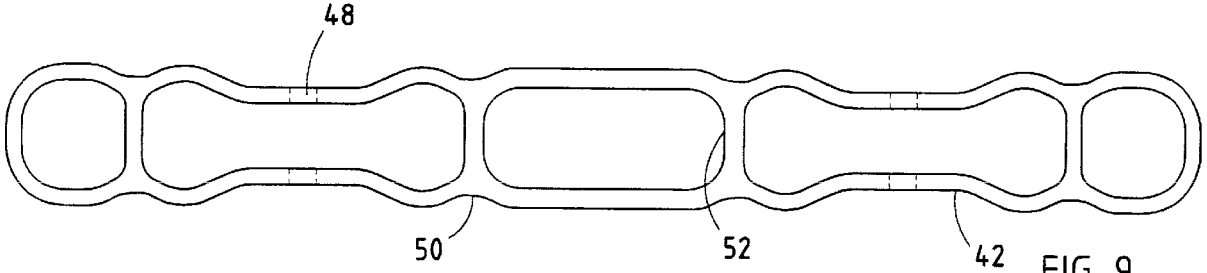
FIG. 9 is a top plan view of the puller/pusher bar of a first embodiment of a workpiece support tray embodying the present invention.
Figure 8:
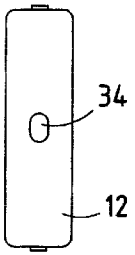
FIG. 8 is an end view of the spacer of a first embodiment of a workpiece support tray embodying the present invention.
Figure 10:
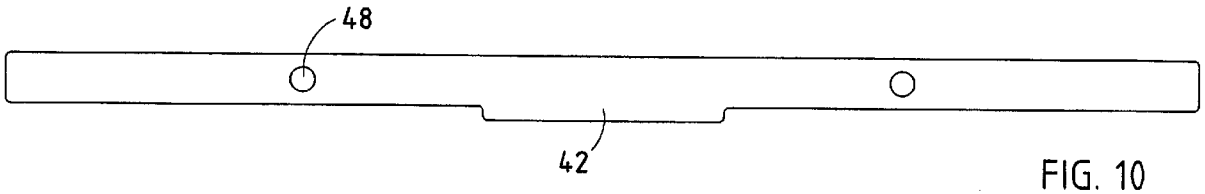
FIG. 10 is a side view of the puller/pusher bar of a first embodiment of a workpiece support tray embodying the present invention.

As shown in FIG. 9, the puller/pusher bar 42 includes curved concave portions 50 near intersections of the members 52. In the preferred embodiment of the spacer 12 shown in FIGS. 1 and 17, there is likewise a concave portion 50 near intersections of the members 54. This is to eliminate thicker areas in the tray 10, which as occurs when the cast part is being poured and that tends to solidify last and shrink. After a while, cracks form in these areas as the relatively thick areas experience contraction at a different rate than thinner areas and the casting will break.

Figure 17:
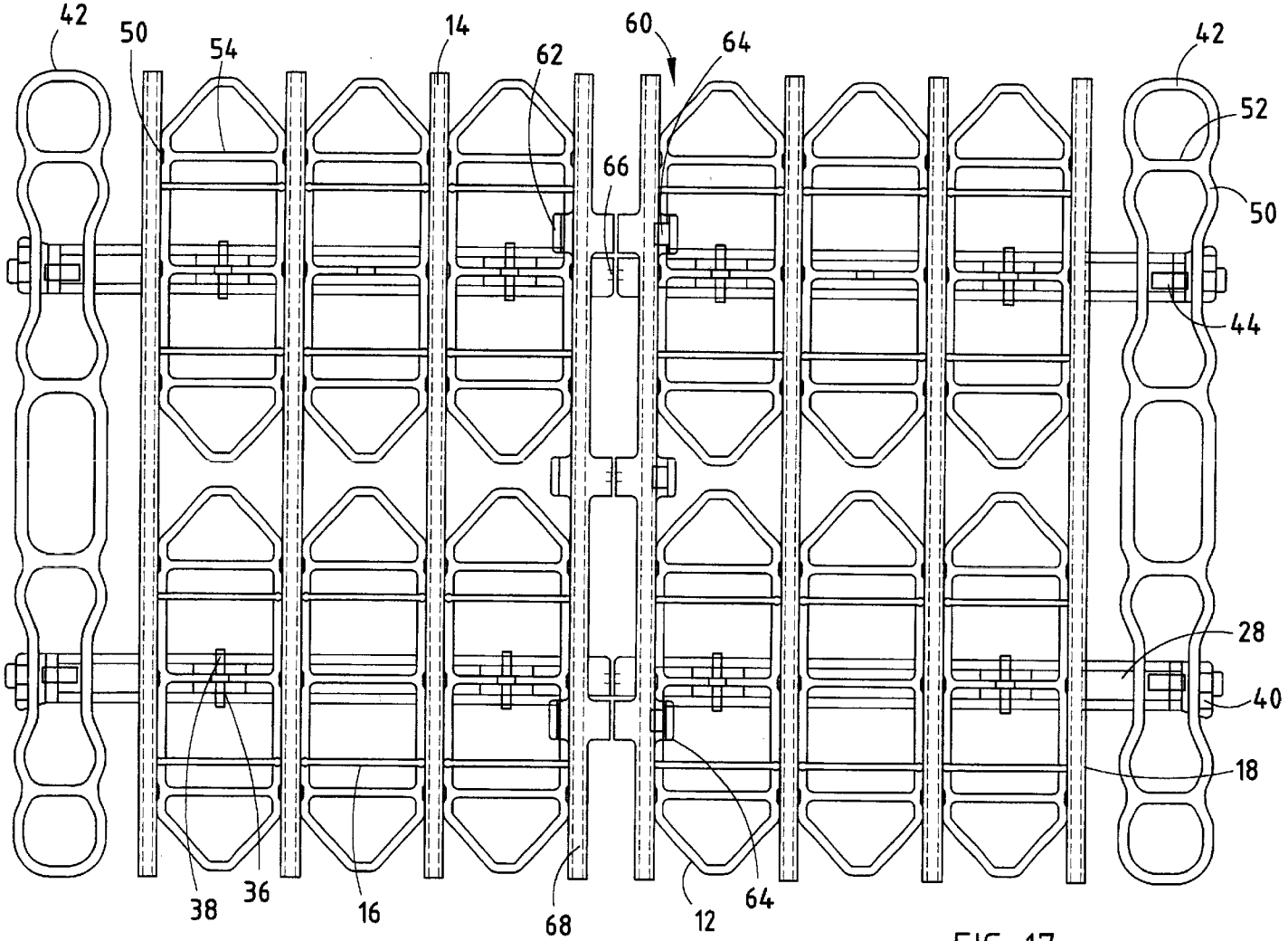
FIG. 17 is a top plan view of a second embodiment of a workpiece support tray embodying the present invention.
Figure 19:
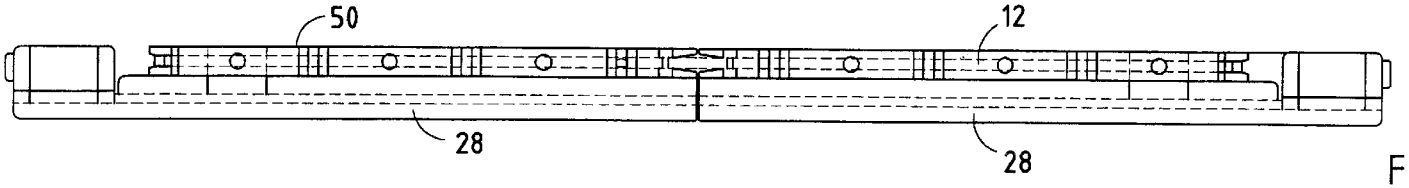
FIG. 19 is a side view of a second embodiment of a workpiece support tray embodying the present invention.
Figure 20:
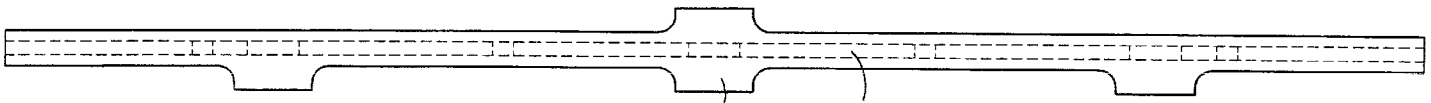
FIG. 20 is a top view of an end I-beam of a second embodiment of a workpiece support tray embodying the present invention.
Figure 22:
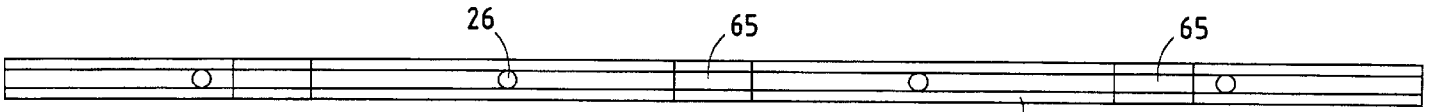
FIG. 22 is a side view of an end I-beam of a second embodiment of a workpiece support tray embodying the present invention.
Figure 24:
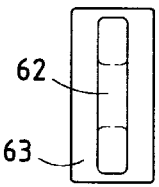
FIG. 24 is an end view of the slide connector of a second embodiment of a workpiece support tray embodying the present invention.
Figure 23:
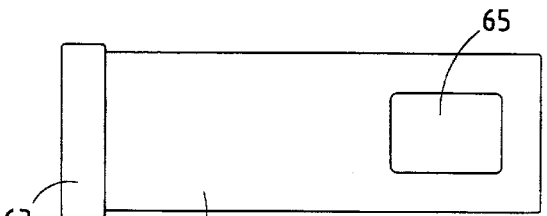
FIG. 23 is a top view of the slide connector of a second embodiment of a workpiece support tray embodying the present invention.
Figure 21:
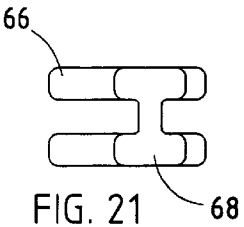
FIG. 21 is an end view of an end I-beam of a second embodiment of a workpiece support tray embodying the present invention.
Figure 25:
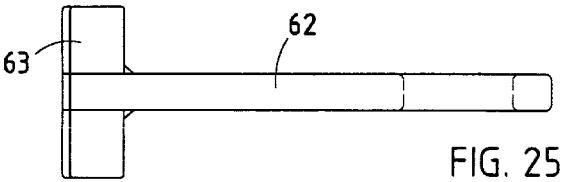
FIG. 25 is a side view of the slide connector of a second embodiment of a workpiece support tray embodying the present invention.
Figure 27:
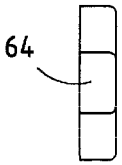
FIG. 27 is an end view of the T-connector of a second embodiment of a workpiece support tray embodying the present invention.
Figure 26:
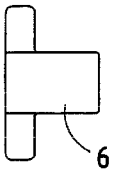
FIG. 26 is a side view of the T-connector of a second embodiment of a workpiece support tray embodying the present invention.

A further improvement according to the present invention is shown in FIG. 17, where an articulating attachment 60 for joining one tray 10 to another to obtain a floating feature is shown. The articulating attachment 60 includes a slide connector 62 and T-connector 64 spot welded into place when assembled between modified end I-beams 68. The slide connector 62, shown in FIGS. 23, 24, and 25, engages via head 63 oversized openings 65 in cooperating end I-beams 68 of the adjacent trays 10 and is engaged by the T-connector 64, shown in FIGS. 26 and 27. The two components, once loosely assembled between the extending ears 66 of an end I-beam 68, shown in FIGS. 20, 22, and 23, are spot-welded together. The spot welds can be easily ground away to disassemble the trays.

The T-connector 64 extends through the slide connector 62 and opening 65 and locks on the other side of end I-beam 68. The slide connector 62 has a slot 70 through which the T-connector 64 extends. Having a larger head than the slot opening, the T-connector 64 is welded in place. The slot 70 is actually larger so that when the tray 10 grows through heat expansion, it may grow in any direction. In fact, none of the opening interfaces on the tray 10 are tight. Preferably, the tray 10 will rattle if shaken. This feature allows it to expand and contract and float to follow the rollers, as discussed below. The sizing can be determined readily by those skilled in the art using standard formulas for thermal expansion based on the material and component configuration.

The articulated attachment 60 helps the trays 10 more or less float through the furnace and straight on the rollers and give the tray 10 some give, all while maintained no more than an ⅛ inch gap between the trays. Combined with the slight "give" present in each row of spacers, additional articulation is obtained. Thus, the entire assembly of trays 10 will flex as it travels through the IQ furnace.

Moreover, in contrast to the nuts and bolts of the prior art, gaps are not created that snag in the furnace and loose parts do not become dislodged. Also, gaps inherent due to the draft are avoided when bolting two trays together.

A further alternative embodiment is shown in FIGS. 29 through 45, where like structures have been identified with like reference characters. In this embodiment, the shoes 28 are not attached by a fastener 30 or pin 36, but rather by the rod 16 itself through offset ears 72 that project upwardly through an opening in the spacer 12. Each offset ear 72 has an opening 74 through which the rod 16 is inserted, as the rod 16 is simultaneously inserted into the openings 24 of the spacer 12. Again, the openings 74 are preferably larger in size.

Figure 46:
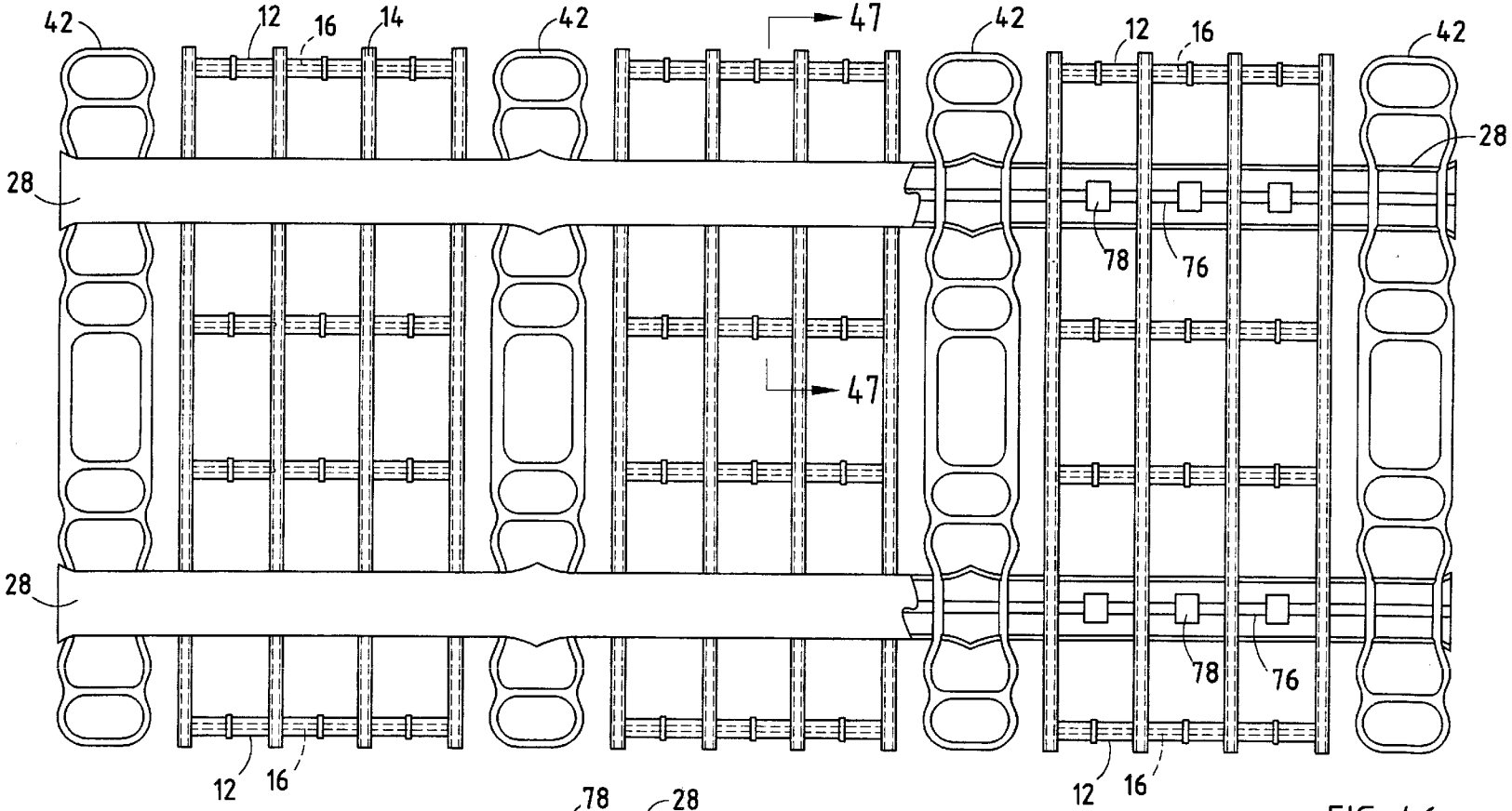
FIG. 46 is a top plan view of a fourth embodiment of a workpiece support tray embodying the present invention.
Figure 47:
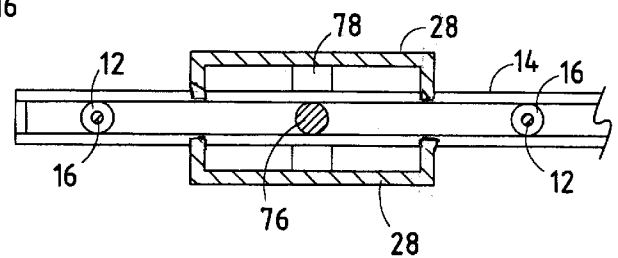
FIG. 47 is a sectional view of the shoe of a fourth embodiment of a workpiece support tray embodying the present invention taken along the line 47—47 in FIG. 46.

A still further embodiment is shown in FIGS. 46 and 47, where like structures have been identified with the reference characters. In this embodiment, spacers 12 are rectangular structures through which rods 16 extend. Also, the shoes 28 are positioned on both sides of the tray, as shown in FIG. 47. An attachment rod 76 extends the length of the tray and extends through the end puller/pusher bars 42, the spacers 12, and tabs 78 extending inwardly from each inner surface of the shoes 28. Alternatively, the shoes 28 may be simply bolted one to the other therethrough and the rod 76 and tabs 78 can be eliminated. In accordance with this embodiment, the tray may be immediately reversed on site, without repair, to correct or overcome warpage or breakage without interruption of operations.

Preferably, the spacers 12, I-beams 14 and 68, shoes 28 and puller/pusher bars 42 are made from ASTN grade H-series cast alloys, particularly HT, HU, HW and HX alloys. HW and HX alloys are preferred for water quench applications and HT and HU alloys are preferred for oil quench applications. As water dissipates heat faster than oil. As the design of the tray 10 is largely based on quenching, where parts can expand and contract because they are loosely attached, the use of an appropriate and similar material throughout the tray 10 is desirable. It is possible that the stress of pulling the ends of the tray 10 through the puller/pusher bar may require materials with relatively high strength.

The assembly can be reversed at any time to correct warpage or sag, that is, it can simply be turned over to correct any deformations. With the design of the present invention, the four fasteners 44 and rods 16 can be readily removed, and the entire spacer 12 removed and flipped over, and put back on. If any of the spacers 12, I-beam 14 or 68, shoe 28 or puller/pusher bars 42 become damaged, it can be removed and replaced, rather than the entire tray 10 scrapped. Also, several damaged trays 10 can be disassembled and combined to form a perfect tray 10. Additionally, it is contemplated that the tray may be adapted to receive a bar frame basket or cast basket or other "fixtures" that may sit on the tray as tabs are positioned around the perimeters, is may be apparent to those with skill in the art.

The drawbacks of the prior art have thus been overcome in an economical, practical and facile matter. While the preferred embodiment and example configuration has been shown and described, it is understood that various modifications and additional configurations would be apparent to those skilled in the art. It is intended that the specific embodiments and configurations disclosed are illustrative of the preferred and best modes for practicing the invention and should not be interpreted as limitations on the scope of the invention, as defined by the appended claims, and is to be appreciated that various changes, rearrangements and modifications may be made therein without departing from the scope of the invention as defined by the appended claims as interpreted according to the principles of patent law, including the doctrine of equivalents.

What is claimed:

1. A flexible, relatively lightweight workpiece support tray for engaging a drive mechanism of a furnace, the tray comprising:

a plurality of spacers juxtaposed between a plurality of lateral I-beams, the I-beams being held together through a plurality of rods;

a pair of shoes located on and removably attached to the bottom intended side of the tray; and a puller/pusher bar attached to each end of the shoe for engaging the drive mechanism of the furnace.

2. The tray of claim 1, the shoes including upwardly projecting ears and the spacers including openings, wherein the shoes are removably attached to the spacers through fasteners projecting through the ears, the fastener being positioned above and through openings of the spacers, such that the shoes are located on the bottom intended side of the tray.

3. The tray of claim 2, wherein the shoes may be placed alternatively on opposite sides of the tray to correct warpage or sag.

4. The tray of claim 1, the rods comprising a split ring welded on each end of the rods to removably retain the tray together.

5. The tray of claim 2, the spacer including openings, wherein the inner diameter of the opening of the spacer is larger than the outer diameter of the fastener so that a loose fit is obtained.

6. The tray of claim 1, the shoes including ears and the spacers including openings, wherein the shoes are removably attached to the spacers through pins projecting through the shoes, the pins being positioned above and through openings of the spacers, such that the shoes are located on the bottom intended side of the tray.

7. The tray of claim 5, wherein the pins are drilled to accept cotter keys to prevent the pin from sliding out.

8. The tray of claim 1, wherein the rods are comprised of 330 stainless steel.

9. The tray of claim 1, the shoes including a lip at each end to engage the furnace drive mechanism and gently urge the tray into alignment with the direction of travel of the furnace drive mechanism.

10. The tray of claim 1, the shoes including a bracket located at each end thereof, wherein the puller/pusher bar is attached to an end of the shoes through the bracket.

11. The tray of claim 10, the puller/pusher bar having openings to receive fasteners, the inner diameter of the openings being larger than the outer diameter of the fasteners so that a loose fit is obtained.

12. The tray of claim 1, the puller/pusher bar including intersecting members and having curved concave portions near the intersections of the members.

13. The tray of claim 1, each of the lateral I-beams having a recess for receiving a tab on each side of the spacers.

14. The tray of claim 1, further comprising articulating connecting means.

15. The tray of claim 14, wherein the connecting means comprises a slide connector and T-connector spot welded to the slide connector when assembled.

16. A flexible, relatively lightweight workpiece support tray for engaging a drive mechanism of a furnace, the tray comprising:

a plurality of spacers juxtaposed between a plurality of lateral 1-beams, the I-beams being held together through a plurality of rods, each of the lateral I-beams having a recess for receiving a tab on each side of the spacers;

a plurality of shoes located on and removably attached to the tray, the pair of shoes having offset ears that project upwardly through an opening in the spacer, each offset ear having an opening through which the rod is inserted, the rod being simultaneously inserted into the openings of the spacer; and a puller/pusher bar attached to each end of the shoe for engaging the drive mechanism of a furnace.

17. The tray of claim 16, wherein the openings of the spacers are larger in size than the outer diameter of the rods and wherein the pair of shoes is each removably attached to the bottom intended side of the tray.

18. The tray of claim 16, wherein each of the plurality of shoes includes a pair of opposing shoes, one of each pair of opposing shoes on each side of the tray.

19. A pair of articulated, relatively lightweight workpiece support trays for engaging a drive mechanism of a furnace, each of the trays comprising:

a plurality of spacers juxtaposed between a plurality of lateral I-beams, the I-beams being held together through a plurality of rods, each of the lateral I-beams having a recess for receiving a tab on each side of the spacers;

a pair of shoes located on and removably attached to the bottom intended side of the tray;

a puller/pusher bar attached to each end of the shoe for engaging the drive mechanism of a furnace; and a connector between the trays, the connector including a slide connector and T-connector spot welded to the slide connector when assembled.

20. The pair of trays of claim 19, wherein the slide connector engages oversized openings in cooperating end I-beams of adjacent trays and is engaged by the T-connector.

* * * * *